US006543962B2

(12) United States Patent
Wells

(10) Patent No.: US 6,543,962 B2
(45) Date of Patent: Apr. 8, 2003

(54) SCREED ASSEMBLY WITH IMPROVED SENSITIVITY AND RESPONSE TO VARYING SURFACE CONDITIONS

(75) Inventor: James R. Wells, Wichita, KS (US)

(73) Assignee: Koch Industries, Inc., Wichita, KS (US)

( * ) Notice: Subject to any disclaimer, the term of this patent is extended or adjusted under 35 U.S.C. 154(b) by 0 days.

(21) Appl. No.: 09/820,435

(22) Filed: Mar. 29, 2001

(65) Prior Publication Data

US 2002/0141824 A1 Oct. 3, 2002

(51) Int. Cl.[7] ..... E01C 19/22
(52) U.S. Cl. ..... 404/118
(58) Field of Search ..... 172/439, 444; 404/84.1, 96, 102, 113, 114, 118; 15/235.4

(56) References Cited

U.S. PATENT DOCUMENTS

| | | | | | |
|---|---|---|---|---|---|
| 4,765,772 | A | * | 8/1988 | Benedetti et al. | 404/77 |
| 5,169,279 | A | * | 12/1992 | Zimmerman | 414/703 |
| 5,348,418 | A | * | 9/1994 | Campbell | 404/103 |
| 5,362,177 | A | | 11/1994 | Bowhall et al. | 404/84.1 |
| 5,393,167 | A | * | 2/1995 | Fujita et al. | 404/84.1 |
| 5,511,900 | A | * | 4/1996 | Macku | 404/84.1 |
| 6,056,474 | A | * | 5/2000 | Nolan | 404/118 |
| 6,168,348 | B1 | * | 1/2001 | Meyer et al. | 404/90 |

OTHER PUBLICATIONS

Operating Manual to Blaw–Knox Paver/Finisher, Blaw-Knox Construction Equipment Corp., Mattoon, Illinois; pub. No. PA.MA. R–10–92–10,000.
Quality Paving Guidebook, Cedarapids, A Raytheon Company, p. 5.
Easy Screed III brochure, Carlson Paving Products, Inc., Tacoma, WA.

* cited by examiner

*Primary Examiner*—Thomas B. Will
*Assistant Examiner*—Raymond Addie
(74) *Attorney, Agent, or Firm*—Stinson Morrison Hecker LLP

(57) ABSTRACT

A screed assembly for use with a prime mover adapted to be moved over a surface to distribute material on the surface. The assembly comprises a prime mover, a screed platform having a screed plate forming a bottom surface thereof and first and second sets of tow arms operably coupled between the prime mover and the screed platform. The tow arms of each set are pivotally coupled with the prime mover and the screed platform and the pivotal coupling of one arm is vertically spaced from the pivotal coupling of the other arm of the same set. Depending upon the dynamics of the paving operation being performed, the tow arms of each set may be in a crossed or a non-crossed orientation to provide positive control of the angle of attack of the screed plate relative to the tow angle. A method of maintaining a substantially uniform depth of a material being spread over a surface by a screed is also contemplated by the invention.

20 Claims, 3 Drawing Sheets

SCREED ASSEMBLY WITH IMPROVED SENSITIVITY AND RESPONSE TO VARYING SURFACE CONDITIONS

STATEMENT REGARDING FEDERALLY SPONSORED RESEARCH OR DEVELOPMENT

Not applicable.

CROSS-REFERENCE TO RELATED APPLICATIONS

Not applicable.

BACKGROUND OF THE INVENTION

This invention generally relates to the field of roadway paving and finishing devices. More specifically, this invention relates to a screed assembly having improved ability to control the magnitude of a change in the angle of attack of the screed plate in response to a change in the angle of the tow arms and to control the magnitude of a change in the angle of the tow arms in response to a change in the angle of attack.

Conventional paving and/or finishing assemblies typically consist of two basic units, a tractor or other vehicle capable of distributing paving material (e.g., asphalt or other bituminous materials) and a screed device. The screed device includes a screed platform, a screed plate forming the bottom surface of the platform and a means for towing the platform behind the tractor. During the process of laying down paving material, the screed platform typically is towed behind the tractor by a single pair of tow arms, one arm coupled with one side of the tractor and screed platform and the other arm coupled with the opposing side of the tractor and screed platform. In operation, the tractor tows the screed device in a forward direction with the screed plate contacting the surface to be paved or finished to level and/or smooth the surface.

As the screed device is towed behind the tractor, paving material is distributed under the screed platform. Consequently, the vertical force imparted to the screed plate is increased and the platform is vertically displaced from the existing surface by the applied paving material. The magnitude of this vertical displacement is dictated, in part, by the characteristics of the material and the displacement, in turn, determines the depth or thickness of the layer of material being laid down, i.e., the mat. Irregularities in the surface being paved or in the material properties (e.g., the viscosity or density) of the material being laid down also can affect the vertical displacement of the screed platform. Controlling the magnitude of this vertical displacement is crucial in producing high-quality mats which are of uniform thickness and texture.

The angle between the bottom surface of the screed platform (i.e., the screed plate) and the surface over which paving is being performed commonly is referred to as the "angle of attack". This angle is a primary factor in determining the amount of material that will pass under the screed platform over a given distance and is elemental in controlling mat depth. The angle of attack will always seek an equilibrium, i.e., a substantially constant magnitude wherein the screed plate is moving in a plane essentially parallel to the grade surface. With the standard screed assembly, the magnitude of any change in the angle of attack is equal to the magnitude of any change in the tow angle. The tow angle is the angle, measured at the tow point (i.e., the point at which the tow arms are connected to the tractor), of the tow arms with respect to horizontal. The magnitude of a change in the two angles is the same, but the direction of the change is opposite, i.e., if one increases the other decreases. This result is determined by the linkage used to couple the towing vehicle and the screed platform, namely, a single pair of tow arms, one coupled with each side of the tractor and the screed platform. This linkage causes the entire screed device to act as a single lever, pivoting at the tow point.

As a standard screed platform is pulled behind the towing vehicle, the angle of attack may change intentionally or unintentionally. For instance, if the towing vehicle proceeds over an uneven surface, the angle of attack will change due to the vertical displacement of the vehicle and such changes are undesirable and unintentional. The angle of attack may also be adjusted intentionally by use of a depth crank. Such changes in the angle of attack, whether intentional or unintentional, result in mats that are either thicker or thinner, depending upon the direction of the change. For example, if the density of the paving material decreases, the vertical force imparted to the screed plate also decreases causing the screed plate to drop until the screed platform reaches an equilibrium, i.e., until the screed plate is again moving in a plane essentially parallel to the grade surface. This drop simultaneously increases the angle of attack and decreases the tow angle by the same magnitude. This permits less material to pass beneath the platform and causes the mat depth to decrease. Alternatively, if the density of the paving material increases, the vertical force imparted to the screed plate also increases causing the screed plate to rise until the screed platform reaches an equilibrium. This rise decreases the angle of attack and increases the tow angle by the same magnitude. This permits more material to pass beneath the platform and causes the mat depth to increase.

Paving over a flat, level surface with all variables held constant, a conventional screed assembly will produce a mat of constant profile. However, unevenness of the surface being paved can change the mat profile. When the plane in which the tractor is traveling changes, e.g., due to irregularities in the surface being paved, the tow angle changes accordingly. As a result, the angle of attack changes as does the thickness of the mat. Accordingly, due to irregularities in the surface being paved, evenness in the final thickness of the mat may vary. Such is not a desirable result as a smooth, even mat of uniform thickness is desired. In such circumstances, it would be desirable to have a screed assembly in which a change in the angle of attack was lesser in magnitude than the corresponding change in the tow angle rather than equal.

Circumstances also exist when it is desirable for the angle of attack to change more rapidly and/or more dramatically than the tow angle. For example, a change in the properties of the paving material, e.g., the viscosity or aggregate properties, may cause a change in the angle of attack and thus the thickness of the mat which is not desired. In such circumstances, it would be desirable to have a screed assembly in which a change in the angle of attack was greater in magnitude than the corresponding change in the tow angle rather than equal so as to compensate for the change in physical properties of the applied material.

Accordingly, there is a continuing need in the paving and finishing industry for a screed device which has improved ability to control the magnitude of the change in the angle of attack of the screed plate in response to a change in the tow angle and to control the magnitude of the change in the tow angle in response to a change in the angle of attack. Additionally, there remains a need for a screed device which may be coupled with the towing vehicle in a manner other than that typically used in the industry providing for improved sensitivity and response in the angle of attack.

SUMMARY OF THE INVENTION

Accordingly, in one of its aspects, the present invention provides a screed assembly having improved ability to control the magnitude of a change in the angle of attack of the screed plate in response to a change in the tow angle such that a change in the angle of attack is not constrained to be equal in magnitude to a change in the tow angle.

In another of its aspects, the present invention provides a screed assembly having improved ability to control the magnitude of a change in the tow angle in response to a change in the angle of attack such that the change in the tow angle is not constrained to be equal in magnitude to a change in the angle of attack.

In a further aspect, the present invention provides a screed assembly having dual sets of tow arms, one set coupled on each side of a prime mover, wherein each set includes at least two tow arms.

In another of its aspects, the invention provides a method of maintaining a more consistent mat depth despite unevenness in the surface to which material is being applied or inconsistencies in the properties of the applied material which comprises pivotally coupling dual sets of tow arms to a paving vehicle, one set on each side of the vehicle, and towing the screed plate over a surface to be paved.

In an additional aspect, the invention provides a method whereby the magnitude of a change in the angle of attack due to inconsistencies in the properties of the applied material is greater than the magnitude of a corresponding change in the angle of the tow arms resulting in a more consistent mat depth.

In a further aspect, the invention provides a method whereby the magnitude of a change in the angle of attack due to unevenness in the surface to which material is being applied which is lesser than the magnitude of a corresponding change in the angle of the tow arms resulting in a more consistent mat depth.

According to the present invention, the foregoing and other aspects are achieved by a screed device for use with a prime mover adapted to be moved over a surface to distribute a material on the surface. The device of the present invention comprises a screed platform, the platform having a screed plate which forms a bottom face thereof, and first and second sets of tow arms operably coupled between the prime mover and the screed platform. Each set of tow arms includes at least two arms and the tow arms of each set are pivotally coupled with the prime mover and the screed platform. In one embodiment, each set of tow arms includes two arms and the pivotal coupling of one arm is vertically spaced from the pivotal coupling of the other arm of the same set.

Aspects of the present invention are further achieved by a roadway paving assembly which comprises a vehicle, a screed platform and first and second sets of tow arms operably coupled between the vehicle and the screed platform. The vehicle of the paving assembly is adapted to be moved over a surface to distribute a material on the surface. Each set of tow arms includes at least two arms and the individual arms of each set are pivotally coupled with the vehicle and the platform. In one embodiment, each set of tow arms includes two arms and the pivotal coupling of one arm is vertically spaced from the pivotal coupling of the other arm of the same set.

Still further, aspects of the present invention are achieved by a method of maintaining a substantially consistent depth of material applied to a surface utilizing a screed platform which is towed by a prime mover, the platform having a screed plate which forms a bottom face thereof. The method of the present invention comprises providing first and second sets of tow arms adapted to extend between the prime mover and the screed platform, pivotally coupling each set of tow arms with the prime mover and the screed platform, and towing the screed platform behind the prime mover over the surface. Each set of tow arms includes at least two tow arms. In one embodiment, each set of tow arms includes first and second arms, the pivotal coupling of the first arm being vertically spaced from the pivotal coupling of the second arm of the same set.

Additional aspects of the invention, together with the advantages and novel features appurtenant thereto, will be set forth in part in the description which follows, and in part will become apparent to those skilled in the art upon examination of the following, or may be learned from the practice of the invention. The aspects and advantages of the invention may be realized and attained by means, instrumentalities and combinations particularly pointed out in the appended claims.

BRIEF DESCRIPTION OF THE DRAWINGS

In the accompanying drawings which form a part of the specification and are to be read in conjunction therewith and in which like reference numerals are employed to indicate like parts in the various views.

DETAILED DESCRIPTION OF THE SEVERAL VIEWS OF THE DRAWINGS

The present invention is directed to a screed assembly and/or device for leveling and smoothing a surface ready for material to be applied that has improved ability to control the magnitude of a change in the angle of attack of the screed plate in response to a change in the tow angle as well as to control the magnitude of the change in the tow angle in response to a change in the angle of attack. The particular embodiments described herein are intended in all respects to be illustrative rather than restrictive. Alternative embodiments will become apparent to those skilled in the art to which the present invention pertains without departing from its scope.

Figure 1:
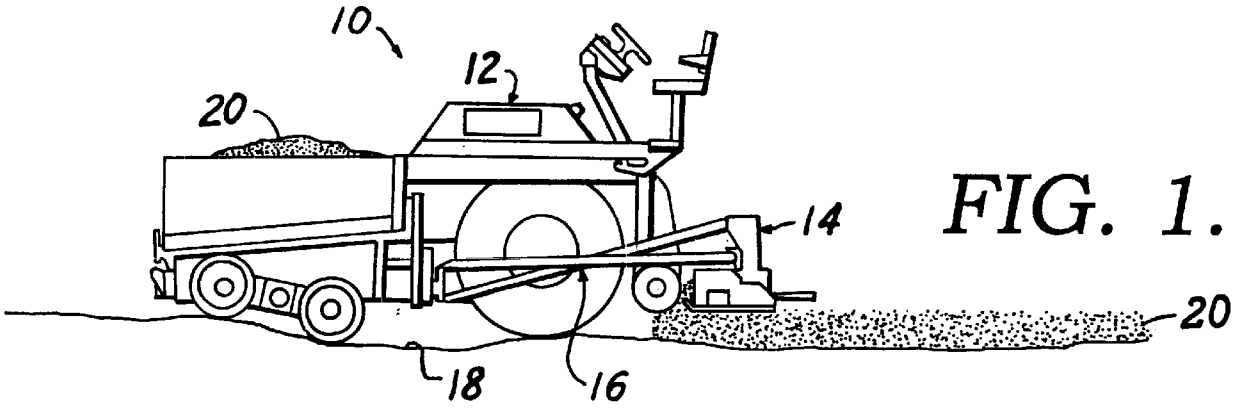
FIG. 1 is a side elevational view of a screed assembly illustrating the tow arms coupled with the screed platform in accordance with a preferred embodiment of the present invention.

Referring to the drawings in general and initially to FIG. 1 in particular, wherein like reference numerals identify like elements in the various views, a screed assembly manifesting aspects of a preferred embodiment of the invention is illustrated and is designated generally by the numeral 10. Screed assembly 10 includes a prime mover 12, a screed platform 14 and two sets of tow arms 16. It will be understood and appreciated that prime mover 12 may be any apparatus capable of distributing material over a surface (not just a road surface) and all such apparatus are contemplated to be within the scope of the present invention. In FIG. 1, prime mover 12 is a paving vehicle. Each set of tow arms 16 is coupled between the vehicle 12 and the screed platform 14 as more fully described below.

Vehicle 12 is adapted to be moved over a surface 18 to be paved and to distribute paving material 20 (e.g., asphalt or other bituminous pavements) in one or more of a variety of manners known in the art. It will be understood and appreciated that the control dynamics of the screed device of the present invention may have applicability in applications other than paving. For example, the technology of the present invention may be used for laying concrete or the like. Such variations are contemplated to be within the scope of the present invention.

Each set of tow arms 16 includes a first tow arm 22 and a second tow arm 24, each pivotally coupled between the vehicle 12 and the screed platform 14. Tow arms 22, 24 may be of a fixed length or variable length with the appropriate mechanical hardware to adjust the length manually or automatically. Each pivotal coupling of one arm is spaced generally vertically above a pivotal coupling of the other arm of the same set, as more fully described below. Each set 16 must include at least two tow arms and such is the preferred embodiment of the present invention. However, variations of the present invention which include sets comprising more than two tow arms are contemplated to be within its scope.

Screed platform 14 includes a screed plate 26, a mechanism 28 for adjusting the crown of the screed plate and apparatus 30 for manually adjusting the angle of attack and consequently the thickness of the mat produced by the paving operation. As is known to those skilled in the art, a screed device may have a fixed width or the width may be adjustable. It will be understood and appreciated that the present invention may be utilized with screed devices which either include or are void of any mechanism for adjusting the crown and/or width of the screed plate and such is contemplated to be within the scope hereof. Apparatus 30 includes two end plates 32, 34, a push plate 36, a pair of slots 38 and a pin 40. Apparatus 30 is more fully described below. Screed plate 26 includes a generally planar surface 42 for leveling the paving material 20 passing beneath it. Mechanism 28 comprises a turnbuckle 28*a* and a handle 28*b* for adjusting the crown of the screed plate 26 as is well known to those skilled in the art. It will be understood and appreciated that any device which is capable of adjusting the crown of the screed plate may be utilized with the screed device of the present invention and such is contemplated to be within its scope.

Figure 2:
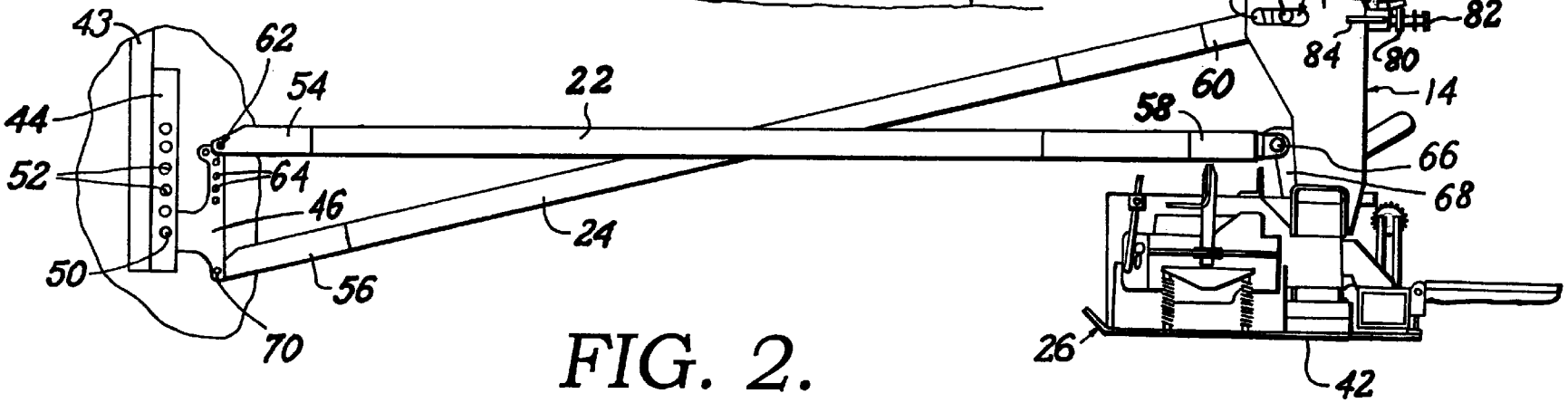
FIG. 2 is an enlarged, fragmentary, side elevational view of a screed device according to the present invention.
Figure 3:
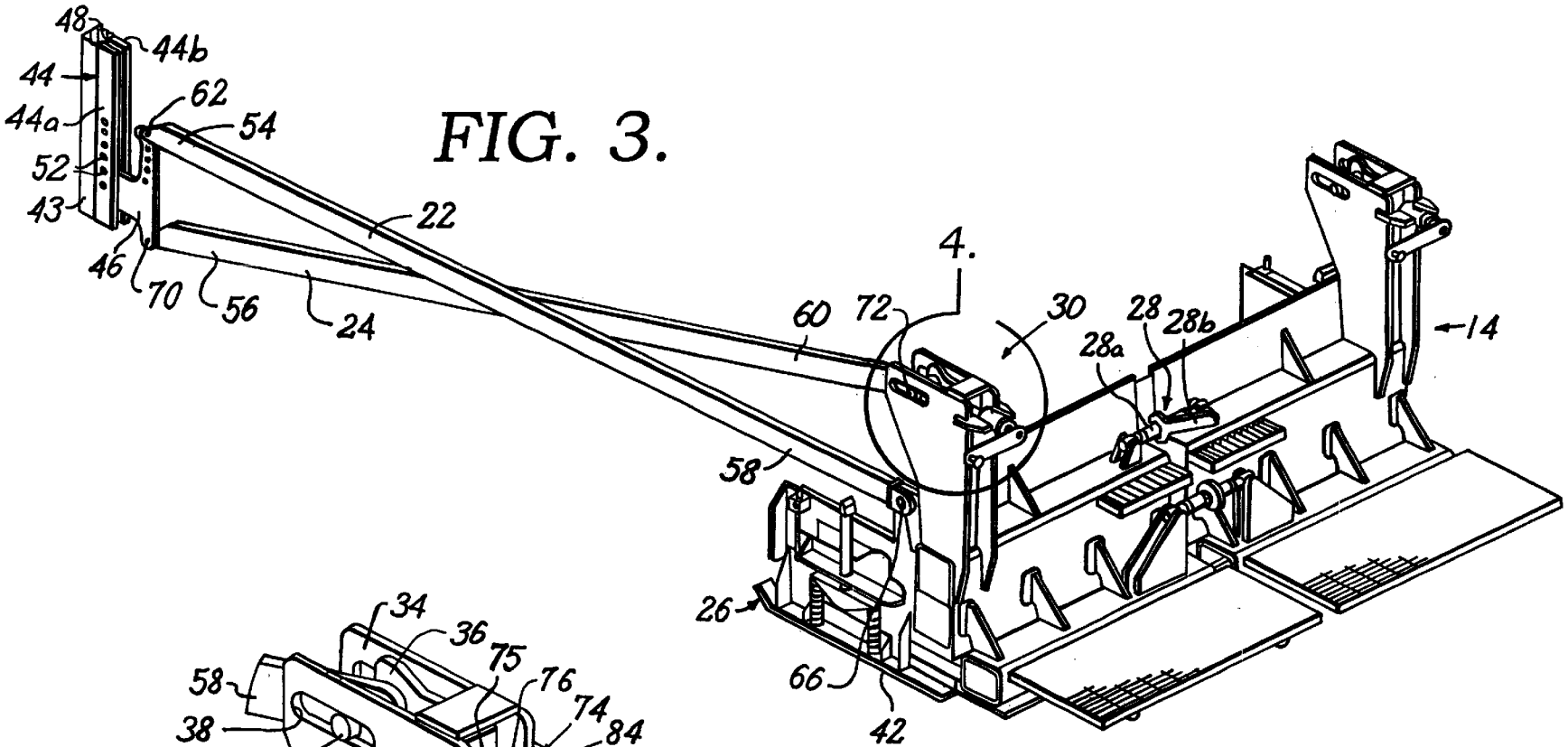
FIG. 3 is a perspective view of the screed device of the present invention.

As best seen in FIGS. 1–3, vehicle 12 includes an attachment plate 43, a vertical support 44 and a shoe 46 for coupling the screed platform 14 with the vehicle. Attachment plate 43 is rigidly coupled with the vehicle by means well known in the art. Vertical support 44 is rigidly coupled with attachment plate 43 by means well known in the art and comprises opposing sides 44*a*, 44*b*. Each of sides 44*a*, 44*b* substantially abuts against attachment plate 43 along the vertical length thereof. As best seen in FIG. 3, each side has a raised side wall which extends along each vertical edge thereof toward the side wall of the opposing side. Opposing sides 44*a*, 44*b*, including their respective side walls, remain spaced from one another forming a vertical track or slot 48 between them with which shoe 46 is moveably coupled. Shoe 46 has an opening (not shown) that is adapted to receive a restraining pin 50 upon coupling the shoe with vertical support 44.

The vertical support includes a plurality of adjustment holes 52 therein for adjusting the vertical position of shoe 46, each hole adapted to receive a restraining pin 50. To stabilize the shoe in the desired vertical position, the opening in shoe 46 and the appropriate adjustment holes of vertical support 44 are aligned and restraining pin 50 is inserted therethrough holding the shoe in place relative to the vertical support. Shoe 46 also has a flat rearward end (not shown) which, when positioned between the sides of vertical support 44 and held in place by restraining pin 50 abuts against attachment plate 43. Accordingly, while the vertical position of shoe 46 may be adjusted relative to vertical support 44, the shoe is not permitted to rotate within the vertical support but rather is held in a fixed position. It will be understood and appreciated that the present invention also may be utilized with a vertical support having a single fixed vertical position for shoe 46 or alternative means for restraining the shoe against rotation. Such is contemplated to be within the scope hereof.

Each tow arm 22, 24 of each set includes a forward end 54, 56, and a rearward end, 58, 60. The forward end of first tow arm 22 includes an aperture therein that receives a pivot pin for pivotally coupling the first tow arm with shoe 46 at an upper tow point 62. Shoe 46 includes a plurality of vertical adjustment holes 64 therein for adjusting the vertical height of the upper tow point. Once the desired height of upper tow point 62 is determined, a pin is inserted into the appropriate adjustment hole, as well as through the aperture in the forward end of first tow arm 22, pivotally holding the arm in the desired vertical position.

In the embodiment illustrated in FIGS. 1–3, the rearward end 58 of the first tow arm 22 is pivotally coupled with the screed platform 14 at a lower pivot point 66. The pivotal coupling may be any coupling known in the art which permits tow arm 22 to pivot at point 66. Preferably, the rearward end of first tow arm 22 includes an aperture therein which is adapted to receive a pivot pin. Screed platform 14 preferably includes a protrusion 68 thereon which has an aperture, also for receiving a pivot pin. To couple the rearward end of first tow arm 22 to the screed platform 14, a pivot pin is inserted into the aperture in the rearward end of the arm and the aperture in protrusion 68 pivotally holding the arm in place at lower pivot point 66.

The forward end 56 of the second tow arm 24 is pivotally coupled with shoe 46 at a lower tow point 70. The forward end 56 of second tow arm 24 includes an aperture that receives a pivot pin for pivotally coupling the second tow arm with shoe 46 at a lower tow point 70. Shoe 46 includes an opening near the lower vertical edge thereof that also receives a pivot pin. To couple the forward end of second tow arm 24 to the shoe, a pivot pin is inserted into the aperture in the forward end of the arm and the lower aperture of the shoe pivotally holding the arm in place at lower tow point 70.

Upper tow point 62 is spaced generally vertically above lower tow point 70. As is apparent, the vertical distance between tow points 62, 70 may be adjusted according to the dynamics of the paving operation being performed by adjusting the position of the upper tow point 62 to a different one of the vertical adjustment holes 64. Adjusting the position of the upper tow point 62 changes the vertical separation of the two tow points.

The rearward end 60 of the second tow arm 24 is pivotally coupled with screed platform 14 at an upper pivot point 72. As best seen in FIGS. 2 and 3, upper pivot point 72 is positioned to cooperate with apparatus 30 for adjusting the thickness of the mat produced by the paving operation. As previously stated, apparatus 30 includes two end plates 32, 34, a push plate 36, a pair of slots 38 and a pin 40. In the embodiment illustrated in FIGS. 2–4, apparatus 30 is shown in the form of a depth crank. It will be understood and appreciated, however, that apparatus 30 may be any of a variety of depth adjustment apparatus known in the art and may be manually actuated, hydraulic, electric or the like. All such variations are contemplated to be within the scope of the present invention.

Figure 4:
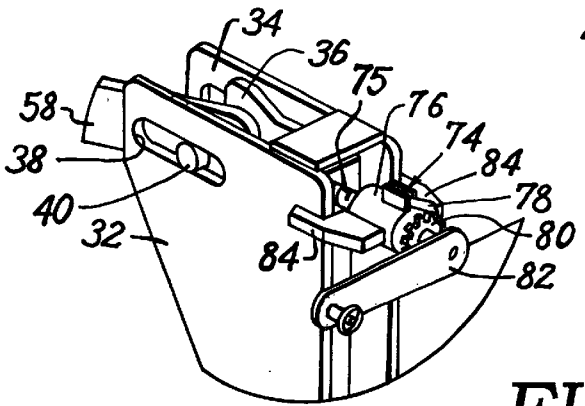
FIG. 4 is an enlarged, fragmentary perspective view of a depth adjustment mechanism of the screed assembly of the present invention illustrating the area encompassed by line 4 of FIG. 3.
Figure 5:
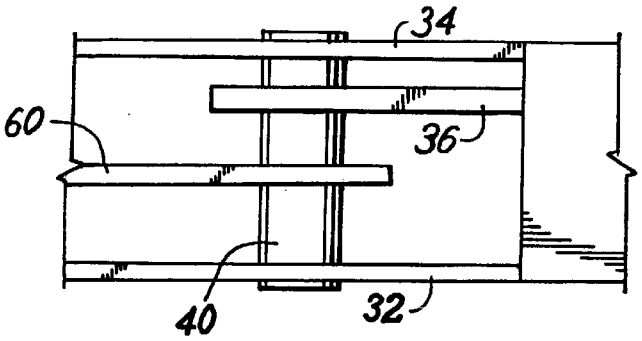
FIG. 5 is a top plan view of the depth adjustment mechanism illustrated in FIG. 4.

Pin 40 extends transversely between end plates 32 and 34, the ends of the pin extending outside of slots 38 on respective sides of apparatus 30. In FIG. 4, only one slot 38 is illustrated and is positioned on end plate 32. However, it will be understood and appreciated that a second slot is similarly positioned on end plate 34. Between end plates 32 and 34 is push plate 36 and the rearward end 60 of second tow arm 24, both coupled with apparatus 30 by pin 40 as more fully described below.

The rearward end 60 of second tow arm 24 includes an aperture therein adapted to receive a pivot pin. Push plate 36 also includes an aperture therein for receiving a pivot pin. To couple the push plate and the rearward end of second tow arm 24 to apparatus 30, the apertures in the rearward end of the arm and the push plate are aligned with slots 38. Subsequently, pin 40 is inserted through the slots and the apertures pivotally holding each of the second tow arm and the push plate in place relative to the end plates 32 and 34.

As best seen in FIG. 4, at the end opposite the aperture for receiving pin 40, push plate 36 is coupled with a mechanism 74 for adjusting the position of upper pivot point 72. Mechanism 74 includes a threaded screw 75 coupled with push plate 36 and a complimentary threaded sleeve 76. Sleeve 76 has a protrusion 78 extending rearwardly therefrom for locking the mechanism in a desired position as more fully described below. Mechanism 74 further includes a toothed wheel 80 having a number of positions adapted to receive protrusion 78 for locking upper pivot point 72 in the desired position and a handle 82. Protruding from opposing sides of sleeve 76 are a pair of retainer wings 84 which are rigid with the sleeve and the end plates and hold the sleeve in its desired position.

Figure 6:
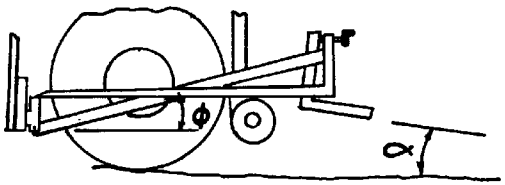
FIG. 6 is a fragmentary, side elevational view of a screed device according to the present invention illustrating the angle of attack, $\alpha$, and tow angle, $\Phi$.

In operation, to change the position of upper pivot point 72 as desired, handle 82 is rotated. The direction of rotation depends upon whether the desired position of upper pivot point 72 is forward or rearward of its original position. As handle 82 is rotated, lock 80 similarly rotates causing protrusion 78 to lock into place in a different one of the lock positions. This rotation of the handle and the lock causes the threaded crank to rotate within sleeve 76 which in turn causes a rotation in the threaded screw. This rotation, in turn, causes the push plate 36 to move either forwardly or rearwardly. As pin 40 extends through the aperture in the push plate, the pin also moves horizontally within slots 38. As pin 40 also extends through the aperture in the rearward end of the second tow arm, this tow arm also moves horizontally. Such movement changes the position of upper tow point 72 as well as the angle of attack, $\alpha$, (FIG. 6) at that point. This change in $\alpha$, in turn, causes a change in the tow angle, $\Phi$, (FIG. 6) which causes an change in the thickness of the mat. It will be understood and appreciated that apparatus 30 described above is merely exemplary and any depth adjustment mechanism known in the art may be substituted therefore and still be considered to be within the scope of the present invention.

FIGS. 1–3 illustrate the attachment of only a single set of tow arms to one side of a paving vehicle and screed platform. It will be understood and appreciated, however, that a second set of tow arms is similarly coupled with the opposing sides of the vehicle and screed platform. Also, references to the "side" of the paving vehicle are understood to apply in the most general sense and refer to any position to one side of the center line of the vehicle. One set of tow arms is located at a first position to the "side" of the center line of the vehicle and the other set is located at a second position equidistant from the center line on its opposite side.

In the embodiment shown in FIGS. 1–3, the forward end 54 of first tow arm 22 is coupled at the upper tow point 62 and the rearward end 58 of the same tow arm is coupled at the lower pivot point 66. Conversely, the forward end 56 of second tow arm 24 is coupled at the lower tow point 70 and the rearward end 60 of the same tow arm is coupled at the upper pivot point 72. Accordingly, first tow arm 22 and second tow arm 24 are crossed over one another. Linkage of dual sets of tow arms oriented in a crossed arrangement as in the present invention permits changes in a which differ in magnitude from corresponding changes in $\Phi$. Intentional adjustments and/or unintentional changes in the position of upper pivot point 72 cause changes in the $\alpha$ which are greater than a corresponding change in $\Phi$. This crossed tow arm arrangement is desirable for accommodating inconsistencies in the physical properties of the paving material, wherein $\alpha$ may need to be changed rather rapidly and/or dramatically. A larger change in $\alpha$ than in $\Phi$ aids in keeping the final thickness of the mat substantially constant despite changes in the stiffness of the paving material.

Figure 7:
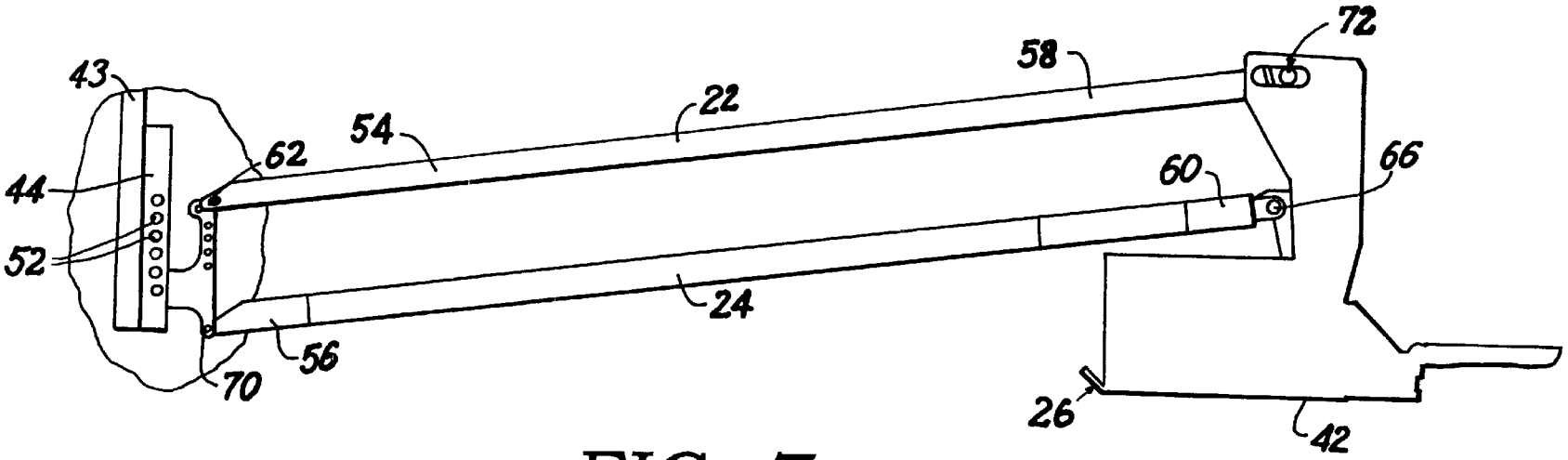
FIG. 7 is an enlarged, fragmentary, side elevational view of a screed device illustrating the tow arms coupled with the screed platform in an alternative embodiment of the present invention.

In an alternate embodiment, illustrated in FIG. 7, the forward end 54 of first tow arm 22 is coupled with the vehicle 12 at the upper tow point 62 and the rearward end 58 of the same tow arm is coupled with the screed platform 14 at upper pivot point 72. Similarly, the forward end 56 of second tow arm 24 is coupled with vehicle 12 at the lower tow point 70 and the rearward end 60 of the same tow arm is coupled with the screed platform 14 at lower pivot point 66. All couplings at both the pivot points and the tow points are as described above. In this embodiment, tow arms 22, 24 are not crossed over one another.

In operation of a screed assembly utilizing the connection of the alternative embodiment, a change in $\alpha$, whether unintentional or intentional, translates into a change of less magnitude than the corresponding change in $\Phi$. This is due to the linkage of the dual sets of tow arms oriented in a non-crossed arrangement. This non-crossed tow arm arrangement is desirable for accommodating uneven roadway surfaces, wherein it is desirable for there not to be a dramatic change in $\alpha$ when the vehicle is subjected to vertical displacement and thus $\Phi$ changes. A lesser change in $\alpha$ than in the $\Phi$ aids in keeping the final thickness of the mat substantially constant despite uneven road surfaces.

The dynamics provided by dual sets of tow arms coupled between the vehicle 12 and the screed platform 14 by the different linkages of the present invention, allow for the sensitivity of a change in $\alpha$ vs. a change in $\Phi$ to be controlled and thus to be more suited to the particular material being applied and the particular surface to which material is being applied. It will be understood and appreciated that changes in $\alpha$ and changes in $\Phi$ may occur intentionally by adjustment of depth crank 30 or unintentionally by virtue of uneven roadway surfaces, changing physical properties of the paving material and the like. The improved ability of the screed paving and finishing assembly of the present invention to control the magnitude of changes in $\alpha$ vs. changes in $\Phi$ applies equally whether the changes are intentional or unintentional.

Constructed and operated as previously described, the present invention provides a screed assembly which has improved ability to control the magnitude of a change in the angle of attack of the screed plate in response to a change in the tow angle such that a change in the angle of attack is not constrained to be equal in magnitude to a change in the tow angle. Further, the present invention provides a screed assembly which has improved ability to control the magnitude of a change in the tow angle in response to a change in the angle of attack such that a change in the tow angle is not constrained to be equal in magnitude to a change in the angle of attack. The present invention additionally provides a screed assembly having dual sets of tow arms, one set coupled on each side of a prime mover, each set including at least two tow arms.

Further, the present invention as applied to road paving applications provides a method of maintaining a more consistent mat depth despite unevenness in the surface being paved or inconsistencies in the properties of the paving material which comprises pivotally coupling dual sets of tow arms to a paving vehicle, one set coupled on each side of the vehicle, and towing the screed platform over a surface to be paved. Additionally, the present invention provides a method whereby the magnitude of a change in the angle of attack due to inconsistencies in the properties of the paving material is greater than the magnitude of a corresponding change in the angle of the tow arms resulting in a more consistent mat depth. Further, the present invention provides a method whereby the magnitude of a change in the angle of attack due to unevenness in the surface being paved which is lesser than the magnitude of a corresponding change in the angle of the tow arms resulting in a more consistent mat depth.

In summary, the present invention is directed to a screed paving device for leveling and smoothing a surface ready to be paved which has improved ability to control the magnitude of a change in the angle of attack of the screed plate in response to a change in the tow angle and to control the magnitude of a change in the tow angle in response to a change in the angle of attack. The present invention has been described in relation to particular embodiments which are intended in all respects to be illustrative rather than restrictive. Alternative embodiments will become apparent to those skilled in the art to which the present invention pertains without departing from its scope.

From the foregoing, it will be seen that this invention is one well adapted to attain all the ends and objects hereinabove set forth together with other advantages which are obvious and which are inherent to the vessel structure.

It will be understood that certain features and subcombinations are of utility and may be employed without reference to other features and subcombinations. This is contemplated by and is within the scope of the claims.

Having thus described the invention, what is claimed is:

1. A screed device for use with a prime mover adapted to be moved over a surface to distribute a material on said surface, said device comprising:

a screed platform, said platform having a screed plate which forms a bottom face thereof, and first and second sets of tow arms operably coupled between the prime mover and said screed platform, said tow arms of each set being pivotally coupled with said prime mover and said platform, wherein each set of tow arms includes a first tow arm and a second tow arm each with a forward end and a rearward end, wherein said forward end of each of said first tow arms is coupled with an upper tow point on said prime mover, said forward end of each of said second tow arms is coupled to a lower pivot point on said prime mover, said rearward end of each of said second tow arms is coupled with an upper pivot point on said platform, and said reward end of each of said first tow arms is coupled to a lower tow point on said platform.

2. The screed device as recited in claim 1 wherein said first set of tow arms is pivotally coupled with a first side of said prime mover and said second set of tow arms is pivotally coupled with an opposite side of said prime mover.

3. The screed device as recited in claim 2 wherein said first set of tow arms is pivotally coupled with a first side of said screed platform and said second set of tow arms is pivotally coupled with an opposite side of said screed platform.

4. The screed device as recited in claim 1 wherein said upper tow point on said prime mover is positioned generally vertically above said lower tow point on said prime mover.

5. The screed device as recited in claim 1 wherein said upper pivot point on said screed platform is positioned generally vertically above said lower pivot point on said screed platform.

6. The screed device as recited in claim 1, further comprising:

an apparatus for adjusting the angle formed between said screed plate and the surface, said apparatus being operably coupled with said screed platform and adapted for moving said upper pivot point of said screed platform forward and backward.

7. A roadway paving assembly, said assembly comprising:

a vehicle adapted to be moved over a surface to distribute a material on said surface;

a screed platform, said platform having a screed plate which forms a bottom face thereof; and first and second sets of tow arms operably coupled between the prime mover and said screed platform, said tow arms of each set being pivotally coupled with said prime mover and said platform, wherein each set of tow arms includes at least a first tow arm and a second tow arm, wherein each tow arm includes a forward end and a rearward end, wherein said forward end of said first tow arm in each set of tow arms is coupled with an upper tow point on said prime mover and said forward end of said second tow arm of each set is coupled to a lower tow point on said prime mover, wherein said rearward end of said second tow arm in each set of tow arms is coupled with an upper pivot point on said platform and said reward end of said first tow arm of each set is coupled to a lower pivot point on said platform.

8. The roadway paving assembly as recited in claim 7 wherein said first set of tow arms is pivotally coupled with a first side of said prime mover and said second set of tow arms is pivotally coupled with an opposite side of said prime mover.

9. The roadway paving assembly as recited in claim 8 wherein said first set of tow arms is pivotally coupled with a first side of said screed platform and said second set of tow arms is pivotally coupled with an opposite side of said screed platform.

10. The roadway paving assembly as recited in claim 7 wherein said upper tow point on said prime mover is positioned generally vertically above said lower tow point on said prime mover.

11. The roadway paving assembly as recited in claim 7 wherein said upper pivot point on said screed platform is positioned generally vertically above said lower pivot point on said screed platform.

12. The roadway paving assembly as recited in claim 7, further comprising:

an apparatus for adjusting the angle formed between said screed plate and the surface, said apparatus being operably coupled with said screed platform and adapted for moving said upper pivot point of said screed platform forward and backward.

13. The roadway paving assembly as recited in claim 7, further comprising:

apparatus for adjusting the angle formed between said screed plate and the surface, said apparatus being operably angled with said screed platform and adopted for moving said upper pivot point forward and backward.

14. A method of maintaining a substantially consistent depth of material applied to a surface utilizing a screed platform which is towed by a prime mover, said platform having a screed plate which forms a bottom face thereof, said method comprising:

providing a first and second set of two arms adapted to extend between the prime mover and the screed platform;

pivotally coupling each set of tow arms with the prime mover and the screed platform, wherein each set of tow arms includes at least a first tow arm and a second tow arm, wherein each tow arm includes a forward end and a rearward end, wherein said forward end of said first tow arm in each set of tow arms is coupled with an upper tow point on said prime mover and said forward end of said second tow arm of each set is coupled to a lower tow point on said prime mover, wherein said rearward end of said second tow arm in each set of tow arms is coupled with an upper pivot point on said platform and said reward end of said first tow arm of each set is coupled to a lower tow point on said platform, towing the screed platform behind the prime mover over the surface to be paved.

15. The method of claim 14 wherein said first set of tow arms is pivotally coupled with a first side of said prime mover and said second set of tow arms is pivotally coupled with an opposite side of said prime mover.

16. The method of claim 15 wherein said first set of tow arms is pivotally coupled with a first side of said screed platform and said second set of tow arms is pivotally coupled with an opposite side of said screed platform.

17. The method of claim 14 wherein said upper tow point on said prime mover is positioned generally vertically above said lower tow point on said prime mover.

18. The method of claim 14 wherein said upper pivot point on said screed platform is positioned generally vertically above said lower pivot point on said screed platform.

19. The method of claim 14, further comprising:

an apparatus for adjusting the angle formed between said screed plate and the surface, said apparatus being operably coupled with said screed platform and adapted for moving said upper pivot point of said screed platform forward and backward.

20. The method of claim 16 whereby the change in the angle of attack is greater than the change in the tow angle.

* * * * *